US007819596B2

(12) United States Patent
Komatsu

(10) Patent No.: US 7,819,596 B2
(45) Date of Patent: Oct. 26, 2010

(54) LABEL MAKING METHOD, PRINTER CONTROL APPARATUS, PROGRAM USED BY PRINTER CONTROL APPARATUS, AND RECORDING MEDIUM WHERE PROGRAM USED BY PRINTER CONTROL APPARATUS IS RECORDED

(75) Inventor: Takashi Komatsu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 440 days.

(21) Appl. No.: 11/366,542

(22) Filed: Mar. 3, 2006

(65) Prior Publication Data

US 2006/0197984 A1 Sep. 7, 2006

(30) Foreign Application Priority Data

Mar. 7, 2005 (JP) ..... 2005-062245

(51) Int. Cl.
*B41J 11/44* (2006.01)

(52) U.S. Cl. ..... 400/76; 400/621; 358/1.1

(58) Field of Classification Search ..... 358/1.1; 400/76, 615.2, 621–621.1
See application file for complete search history.

(56) References Cited

U.S. PATENT DOCUMENTS 4,939,674 A * 7/1990 Price et al. ..... 358/1.9
5,239,622 A * 8/1993 Best et al. ..... 358/1.18
5,602,377 A * 2/1997 Beller et al. ..... 235/462.15
5,794,213 A * 8/1998 Markman ..... 705/23
6,244,763 B1 * 6/2001 Miller ..... 400/76
6,716,032 B2 * 4/2004 Reisz et al. ..... 434/178

FOREIGN PATENT DOCUMENTS

| | | |
|---|---|---|
| JP | 5-229542 | 9/1993 |
| JP | 5-246414 | 9/1993 |
| JP | 5-318631 | 12/1993 |
| JP | 07117286 A | 5/1995 |
| JP | 9-267523 | 10/1997 |
| JP | 2000-222155 | 8/2000 |
| JP | 2004-234264 | 8/2004 |

OTHER PUBLICATIONS

Notice of Rejection of Japanese Application JP2005-062245 issued date Apr. 30, 2010, pp. 1-2.

* cited by examiner

*Primary Examiner*—Ren Yan
*Assistant Examiner*—Marissa L Ferguson-Samreth
(74) *Attorney, Agent, or Firm*—Oblon, Spivak, McClelland, Maier & Neustadt, L.L.P.

(57) ABSTRACT

A label making method for making a label where information is printed by a label printer; includes the step of making the label printer recognize a continuous plurality of data sets as single data sets to be printed on a single label. In this method, the plural data sets may be arranged in at least one direction of a line direction being a sending direction of the label and a row direction perpendicular to the line direction.

18 Claims, 12 Drawing Sheets

FIG.3

| PRODUCTION YEAR AND MONTH | LOT NUMBER | PART NUMBER | PRODUCTION NUMBER |
|---|---|---|---|
| 2005/2 | 05021291J | N5017159 | 50 |
| 2005/2 | 05021292J | N5017160 | 50 |
| 2005/2 | 05021293J | N5017161 | 50 |
| | | | |

FIG.4

| PART NUMBER | WAY OF PRINTING | COLOR | KINDS OF SHEET | LAST NUMBER |
|---|---|---|---|---|
| N5017159 | 5×2 DESCENDING ORDER | BLACK | A | 1306 |
| N5017160 | 3×2 DESCENDING ORDER | BLACK | B | 1810 |
| N5017161 | 5×2 DESCENDING ORDER | BLACK | A | 980 |
| | | | | |

| KINDS OF SHEET | LABEL SIZE (mm) | LABEL ARRANGEMENT | GAP (mm) | RIGHT AND LEFT MARGINS (mm) | ROLL LENGTH(m) |
|---|---|---|---|---|---|
| A | 50×25 | 1 | 5 | 3 | 39 |
| B | 25×25 | 1 | 5 | 3 | 39 |
| C | 50×20 | 1 | 5 | 3 | 39 |
| | | | | | |

FIG.10

| | |
|---|---|
| PRODUCTION YEAR AND MONTH | 2005/2 |
| LOT NUMBER | 05021291J |
| PART NUMBER | N5017159 |
| START NUMBER | |
| NUMBER OF SHEETS | 50 |
| WAY OF PRINTING | 5×2 DESCENDING ORDER |

OK CLOSE

FIG.11

| | |
|---|---|
| PRODUCTION YEAR AND MONTH | 2005/2 |
| LOT NUMBER | 05021291J |
| PART NUMBER | N5017159 |
| START NUMBER | 1307 |
| NUMBER OF SHEETS | 50 |
| WAY OF PRINTING | 5×2 DESCENDING ORDER |

OK CLOSE

| KINDS OF SHEETS | A | | |
|---|---|---|---|
| THE WAY OF PRINTING | 5×2 | 5×1 | 1×1 |
| NUMBER OF SHEETS | 13000 | 6500 | 1300 |
| SHEET PIECE PRICE (YEN) | 10000 | 10000 | 10000 |
| BARCODE PIECE PRICE (YEN) | 0.77 | 1.54 | 7.69 |

LABEL MAKING METHOD, PRINTER CONTROL APPARATUS, PROGRAM USED BY PRINTER CONTROL APPARATUS, AND RECORDING MEDIUM WHERE PROGRAM USED BY PRINTER CONTROL APPARATUS IS RECORDED

BACKGROUND OF THE INVENTION

1. Field of the Invention

The present invention relates to label making methods, printer control apparatuses, programs used by the printer control apparatuses, and recording media where the programs used by the printer control apparatuses are recorded, and more specifically, to a label making method for making a label where information is printed by using a label printer, a printer control apparatus configured to control the label printer, a program used by the printer control apparatus, and a recording medium where the program is recorded.

2. Description of the Related Art

Recently, a barcode has been used in various industrial fields and found necessary for managing products. A sheet for the barcode (hereinafter "barcode sheet") has been sold by a sheet maker or a label maker. In addition, a label printer for printing the barcode on the barcode sheet has been sold.

The barcode sheet is formed by adhering plural labels on a pasteboard. A gap having a length between approximately 2 through 5 mm is formed between the labels, for example, as shown in FIG. 1.

A normal label printer has a sensor for detecting such a gap. See Japanese Laid-Open Patent Application Publication No. 9-267523, for example.

In the meantime, a label where a barcode indicating a serial number of a product is printed is adhered on a printed circuit board used in an electronic apparatus.

Recently and continuing, as corresponding to demand for making the size of the electronic apparatus small, the size of the printed circuit board becomes small. Based on this, there is a tendency that a label area on the printed circuit board becomes narrow. At this moment, a label of width approximately 25 mm and length approximately 4 mm is in demand.

However, in the label printer disclosed in Japanese Laid-Open Patent Application Publication No. 9-267523, the minimum length of the label for correctly detecting the gap is 6 mm. Accordingly, even if the barcode is small, the number of the barcodes which can be printed on a single barcode sheet cannot be increased.

SUMMARY OF THE INVENTION

Accordingly, the present invention may provide a novel and useful label making method, printer control apparatus, program used by the printer control apparatus, and recording medium where the program used by the printer control apparatus is recorded, of the same solving one or more of the problems discussed above.

Another and more specific object of the present invention may be to provide a label making method whereby a label where continuous plural data sets are printed can be made.

Other object of the present invention may be to provide a printer control apparatus whereby a label printer can be made to print continuous plural data sets on a single label.

Other object of the present invention may be to provide a program implemented by the printer control apparatus, the program whereby the label printer can be made to print continuous plural data sets on the single label and to provide a recording medium where such a program is recorded.

The above-mentioned object of the present invention is achieved by a label making method for making a label where information is printed by a label printer; including the step of:

making the label printer recognize a continuous plurality of data sets as single data sets to be printed on a single label.

The above-mentioned object of the present invention is also achieved by a printer control apparatus configured to control a label printer, including:

a making part configured to make a continuous plurality of data sets be printed on a single label; and a recognition part configured to make the label printer recognize the plural data sets as single data sets to be printed on the single label.

The above-mentioned object of the present invention is also achieved by a printer control apparatus configured to control a label printer, including:

making means for making a continuous plural data sets be printed on a single label; and recognizing means for making the label printer recognize the plural data sets as single data sets to be printed on a single label.

The above-mentioned object of the present invention is also achieved by a computer program used by a printer control apparatus configured to control a label printer, the computer program including the step of:

making the label printer recognize a continuous plurality of data sets as single data sets to be printed on a single label.

The above-mentioned object of the present invention is also achieved by a recording medium storing a computer program, the computer program readable by a computer, the computer program including the step of:

making a label printer recognize a continuous plurality of data sets as single data sets to be printed on a single label.

Other objects, features, and advantages of the present invention will become more apparent from the following detailed description when read in conjunction with the accompanying drawings.

BRIEF DESCRIPTION OF THE DRAWINGS

FIG. 3 is a table for explaining production control information;

FIG. 4 is a table for explaining machine information;

FIG. 10 is a second view for explaining the barcode printing process;

FIG. 11 is a third view for explaining the barcode printing process;

DETAILED DESCRIPTION OF THE PREFERED EMBODIMENTS

A description of the present invention and details of drawbacks of the related art are now given, with reference to FIG. 2 through FIG. 16, including embodiments of the present invention.

Figure 1:
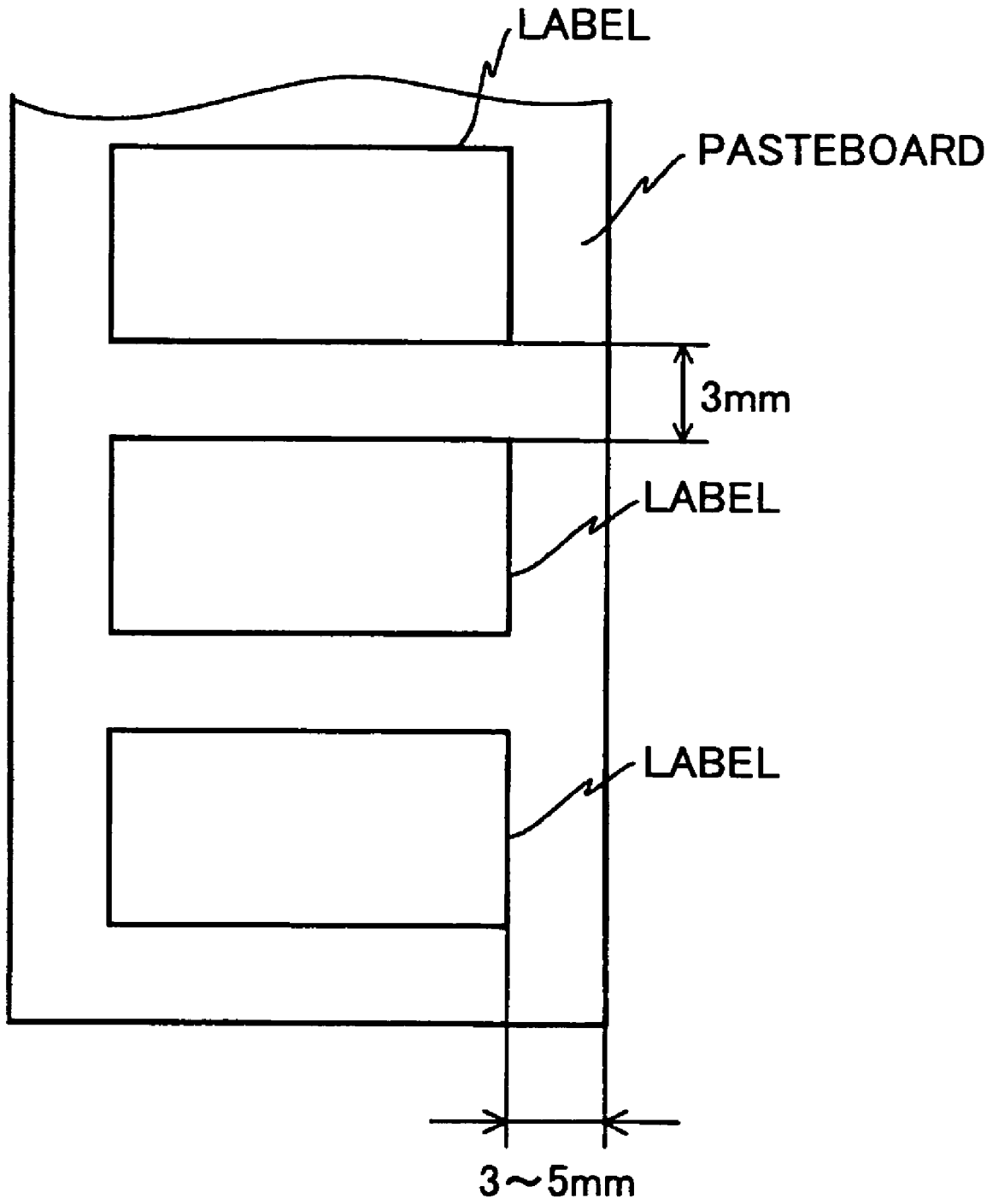
FIG. 1 is a plan view for explaining a sheet.
Figure 2:
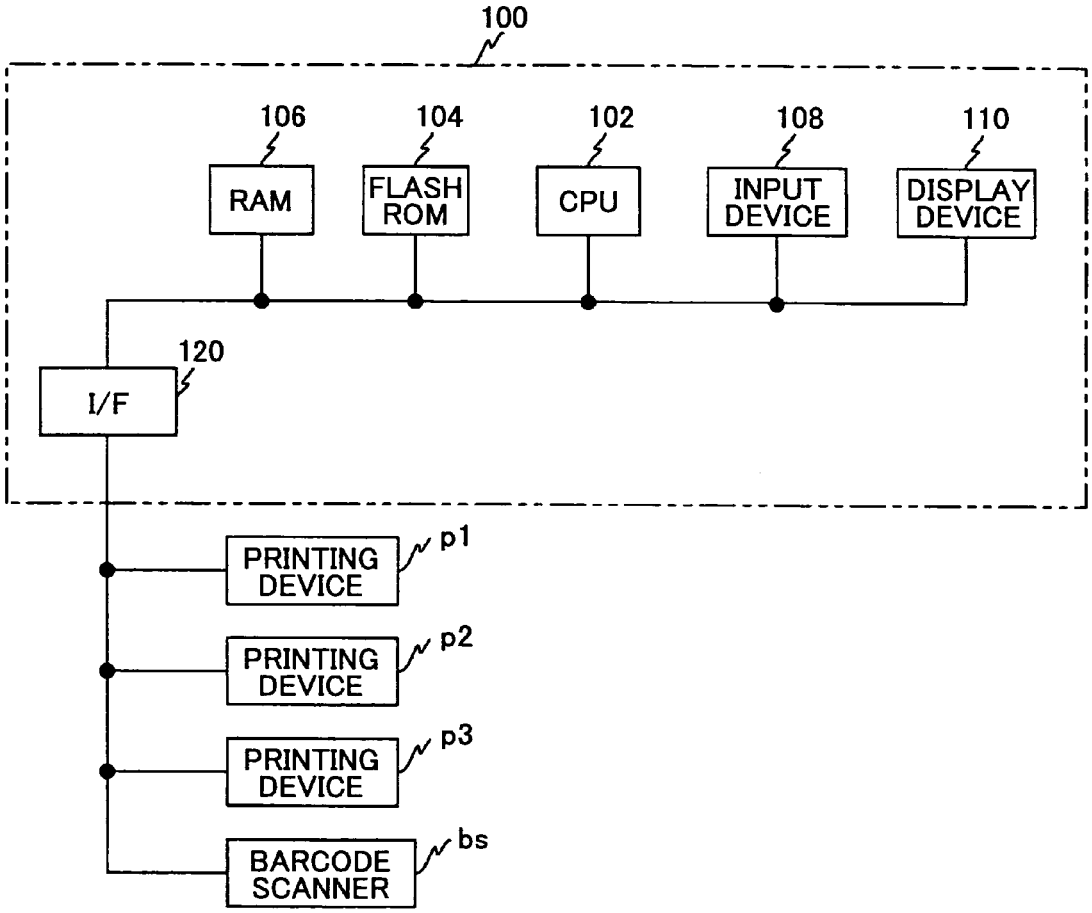
FIG. 2 is a block diagram showing a schematic structure of a personal computer as a printer control apparatus of an embodiment of the present invention.

FIG. 2 is a block diagram showing a schematic structure of a personal computer 100 as a printer control apparatus of an embodiment of the present invention.

The personal computer shown in FIG. 2 includes a CPU 102, a flash ROM 104, a RAM 106, an input device 110, interface 120, and others.

The flash ROM 104 is formed by a program area and a data area. Plural programs including a program of the present invention, the program being described by code that can be read by the CPU 102, are stored in the program area. Production control information, machine information, sheet information, printing history information, and others are stored in the data area.

The production management information includes, as shown in FIG. 3, production year and month, the lot number of a lot produced in the above-mentioned production year and month, the part number of a machine produced by the lot, and the number of production, for example.

Figures 5, 6:
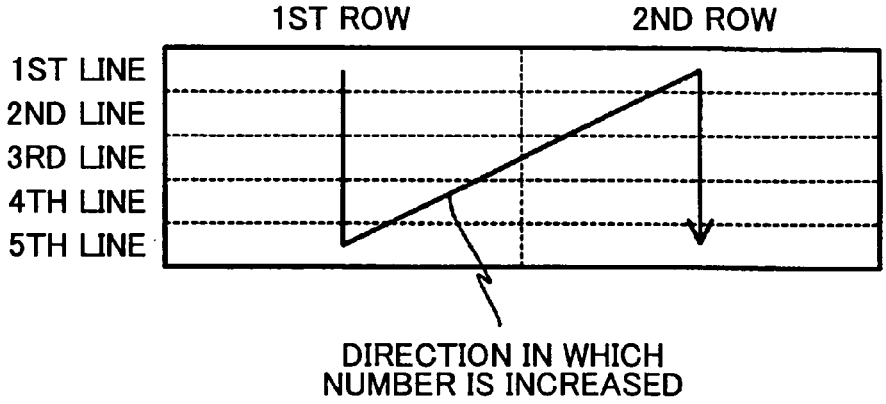
FIG. 5 is a graph for explaining a printing format.
FIG. 6 is a table for explaining sheet information.

The machine information includes, as shown in FIG. 4, a part number, the way of printing, color, kinds of the sheet, and last number produced, for example. The way of printing indicates an arrangement of the barcode when plural barcodes are printed on a single label. For example, "5×2" means arrangement of 5 lines 2 rows as shown in FIG. 5. The "descending order" means, in this case, the number is increased from the first line of the first row to the fifth line of the first row and then from the first line of the second row to the fifth line of the second row. Here, a line direction is a sending direction of the label and a row direction is perpendicular to the line direction.

As shown in FIG. 6, for example, the paper information includes a label size (width and length) being a size of one label, and a label arrangement being the number of the labels in a width direction. In this example, a roll sheet is used. A cut corresponding to the way of printing is formed in the label in advance so that the printed barcode is peeled from the pasteboard individually.

The display device 110 shown in FIG. 2 includes, for example, a display part (not shown in FIG. 2) using a liquid crystal display (LCD). The display device 10 displays various information items as instructed by the CPU 102.

The input device 108 includes an input part (not shown in FIG. 2) such as a keyboard or the like. The input device 108 sends various information items input by a user to the CPU 102.

The interface 120 is a communication interface for implementing bidirectional (interactive) communication with the printing device.

The CPU 102 follows the above-mentioned program stored in the flash ROM 104 so as to control operation of the above-mentioned parts, and stores data necessary for controlling in the RAM 106.

In this embodiment, as an example, three printing devices p1, p2 and p3 as label printers and a barcode scanner bs are connected to the personal computer 100 via the interface 120.

Next, an operation of the personal computer 100 in a case where an operator inputs a label making request via the input device 108 is discussed with reference to FIG. 7 and FIG. 8. Flowcharts shown in FIG. 7 and FIG. 8 correspond to a process algorithm implemented by the CPU 102.

Based on the receipt of the label making request from the input device 108, a head address of a program (hereinafter "label making process program") corresponding to the flowchart shown in FIG. 7 and FIG. 8 stored in the flash ROM 104 is loaded in a program counter of the CPU 102, so that a label making process starts. Here, as an example, a barcode having continuous numbers is printed.

In step 401, information of connected printing devices is obtained. More specifically, names of the respective printing devices, connection ports, and others are obtained.

In step 403, the respective printing devices are initialized. Nothing is applied to a printing device of which initialization is not required.

Figure 9:
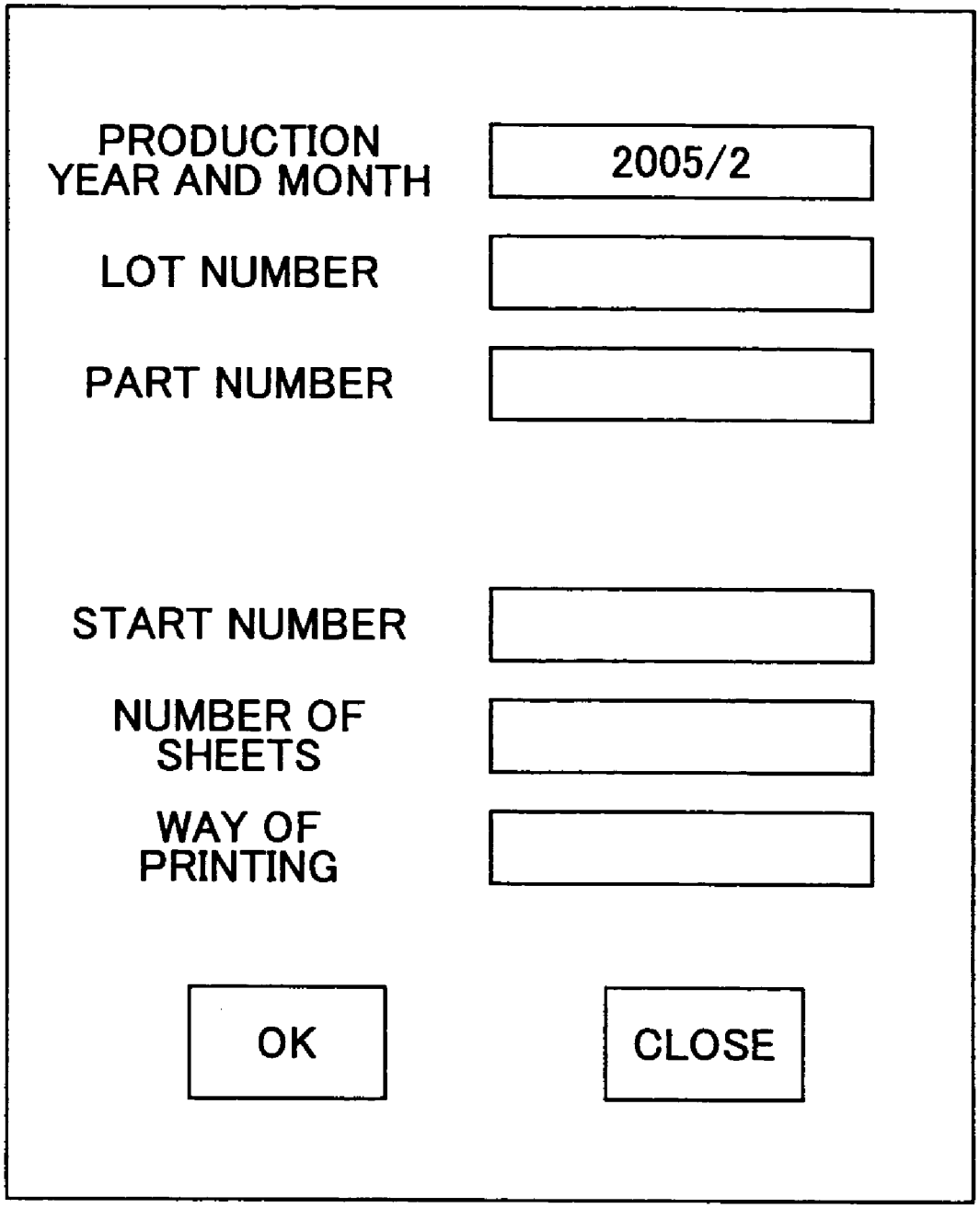
FIG. 9 is a first view for explaining the barcode printing process.

In step 405, an input screen such as printing information is displayed via the display apparatus 110. Here, as an example, as shown in FIG. 9, the lot number, the part number, the start number, the number of sheets, and the way of printing can be input.

In step 407, whether the lot number is input is determined. More specifically, when a designated-digit number is input in an input column of the lot number, the determination in this step is affirmed so that the process goes to step 409.

In step 409, the production management information shown in FIG. 3 is searched based on the input lot number so that the part number corresponding to the input lot number and the production number are obtained. The obtained part number and the production number are displayed via the display apparatus 110 as shown in FIG. 10. The number of productions is displayed in a column of the number of sheets. In the following, the number of sheets indicates the number of necessary bar codes.

In step 411, the machine information (See FIG. 4) is searched based on the part number so that the last number printed, the kind of the sheets, color, and the way of printing corresponding to the part number are obtained. As shown in FIG. 11, the number formed by adding one to (incrementing) the obtained last number is displayed as the last number via the display device 110.

In step 413, the sheet information (See FIG. 6) is searched based on the kind of the sheet so that the row number, line number and the label size corresponding to the kind of the sheet are obtained.

In step 415, pushing of the "OK" button is waited. The start number and the piece of the sheets can be changed. If the "OK" button is pushed, the determination here is affirmed so that the process goes to step 417.

In step 417, the printing device is determined based on the kind of the sheets and the printing color. Here, one printing device is selected from three printing devices.

Figure 12:
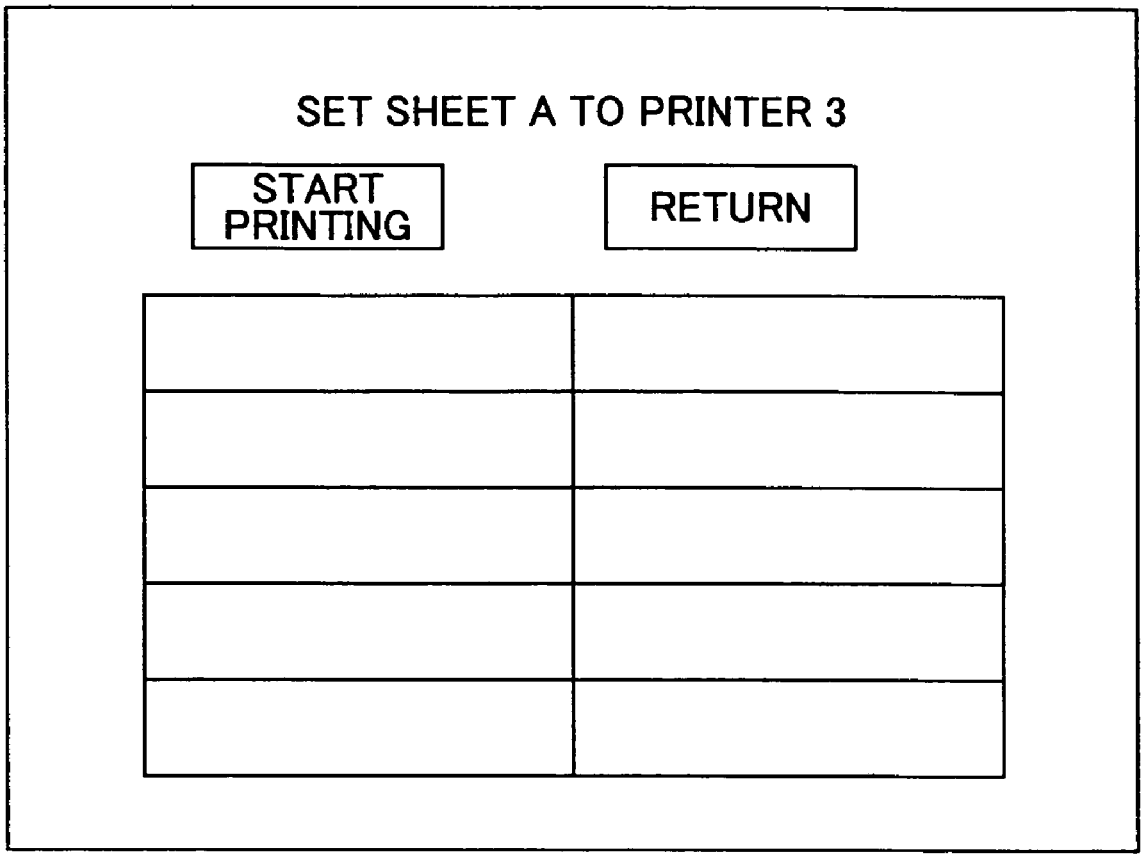
FIG. 12 is a fourth view for explaining the barcode printing process.
Figure 13:
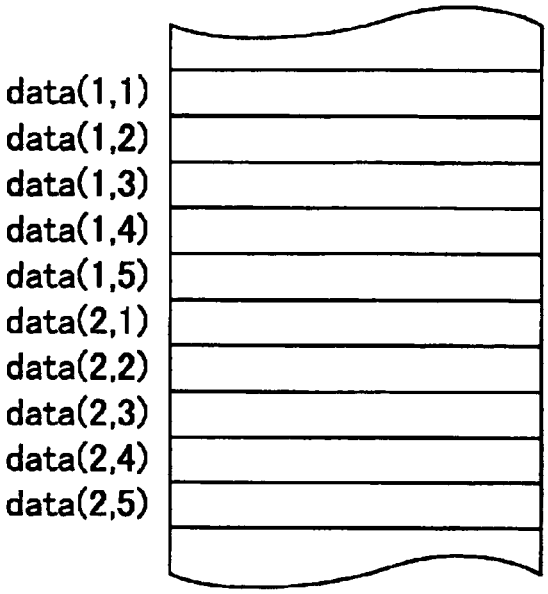
FIG. 13 is a view for explaining a data storage area.

In step 419, as shown in FIG. 12, a screen encouraging sending the sheet to the printing device is displayed via the display device 110.

In step 421, pushing of "start printing" is waited. If "return" button is pushed prior to the "start printing", the display returns to the display before the "OK" button is pushed. If the "start printing" button is pushed, the determination here is affirmed so that the process goes to step 423.

In step 423, the paper information is output to the printing device so that the process goes to step 501.

In step 501, as shown in FIG. 12, data storage area of a two-dimensional arrangement is secured in the RAM 106 as corresponding to the way of printing. Here, the data storage area is indicated as "data (i, j)" wherein "i" indicates a row and "j" indicates a line.

In step 503, the starting number is set in a variable "m" indicating the printing number.

In step 505, an initial value "0" is set in a counter "n" indicating the number of printed barcodes.

Figure 14:
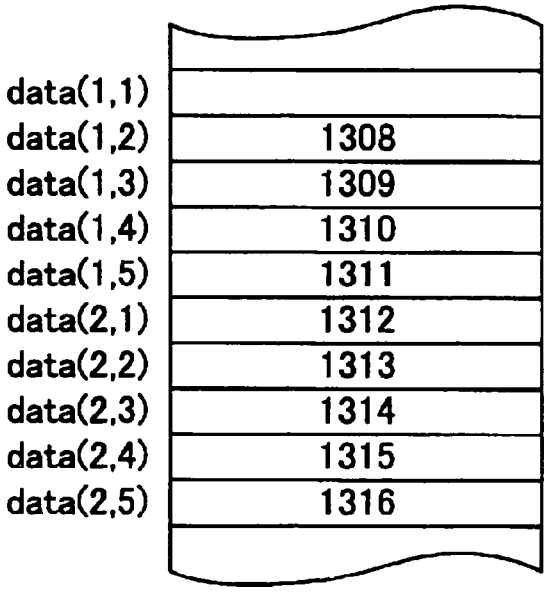
FIG. 14 is a view for explaining data stored in the data storage area.

In step 507, the data storage area of two-dimensional arrangement is initialized. Here, data not being converted into the barcodes, such as null data, are stored in the data storage area In step 509, as shown in FIG. 14, the printing data are stored in the data storage area of two-dimensional arrangment. More specifically, "m" is stored in data (1, 1), "m+l" is stored in data (1, 2), "m+2" is stored in data (1, 3), "m+3" is stored in data (1, 4), "m+4" is stored in data (1, 5), "m+5" is stored in data (2, 1), "m+6" is stored in data (2, 2), "m+7" is stored in data (2, 3), "m+8" is stored in data (2, 4), and "m+9" is stored in data (2, 5).

In step 513, position information against a standard position of the label where the printing data are printed is obtained based on the property of the selected printing device, the label size, label arrangement, and others.

In step 514, printing information including the above-mentioned position information and the printing data is generated.

Figures 15, 16:
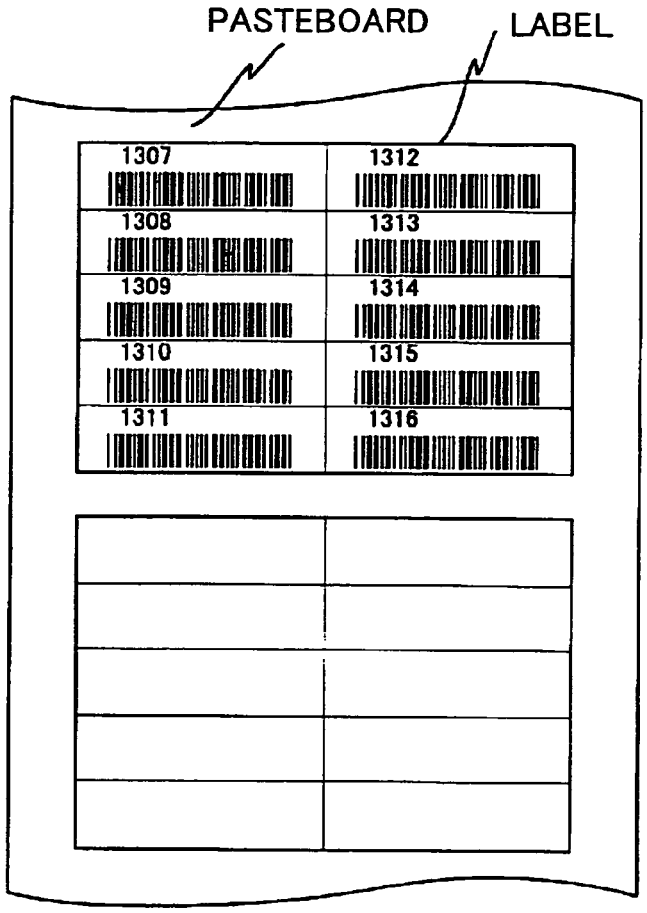
FIG. 15 is a view for explaining a printing result.
FIG. 16 is a table for explaining differences of barcode piece price.

In step 515, the above-mentioned printing information is output to the selected printing device. In this case, the printing data stored in the data storage area are output at one word unit by using a special term so as to follow a command of the connected printing device. In other words, the printing data stored in the data storage area are recognized as printing data sets to be printed on a single label. Thus, as shown in FIG. 15, for example, plural barcodes (data sets) are printed on a single label.

Next, in step 517, the numbers of printed pieces being the printed barcode numbers are added into "m".

In step 519, the numbers of printed pieces are added into "n".

In step 521, whether the value of "n" is less than the designated number of the pieces is determined. If the value of "n" is less than the designated number of the pieces, the determination is affirmed so that the process goes back to step 507. On the other hand, if the value of "n" is not less than the designated number of the pieces, the determination is denied so that the process goes to step 523.

In step 523, whether the barcode is included in the printing data is determined. If the barcode is included in the printing data, the determination here is affirmed so that the process goes to step 525.

In step 525, the operator is instructed so as to read the first barcode and the last barcode by using the barcode scanner bs.

In step 527, the first barcode and the last barcode are collated so that whether the first barcode and the last barcode are normally read and whether there is number skip or number overlap is determined. If the first barcode and the last barcode are normally read and there is no number skip or number overlap, the determination here is affirmed so that the process goes to step 529.

In step 529, the last number of the machine information is renewed to the present value "m".

In step 533, the lot number, the part number, the number of the prices, the last number, the printing status, the date of printing, and the name of the operator are added into the printing history information so that the label making process is completed.

If the first barcode and the last barcode are not normally read or there is number skip or number overlap in the above-mentioned step 527, the determination here is negative so that the process goes to the step 531. In step 531, for example, a message like "This label cannot be used. Please destroy this label." is displayed on a display device 110 so that the operator is notified about the destruction of the label and the process goes to step 533.

If the barcode is not included in the printing data in step 523, the determination here is negative so that the process goes to the step 529.

Thus, as discussed above, in the personal computer 100 of the embodiment of the present invention, the making part and the recognition part are realized by the program implemented by the CPU 102 and the CPU 102. At least a part of or all of the making part and the recognition part realized by the process of the program by the CPU 102 may be formed by a hardware.

Figure 7:
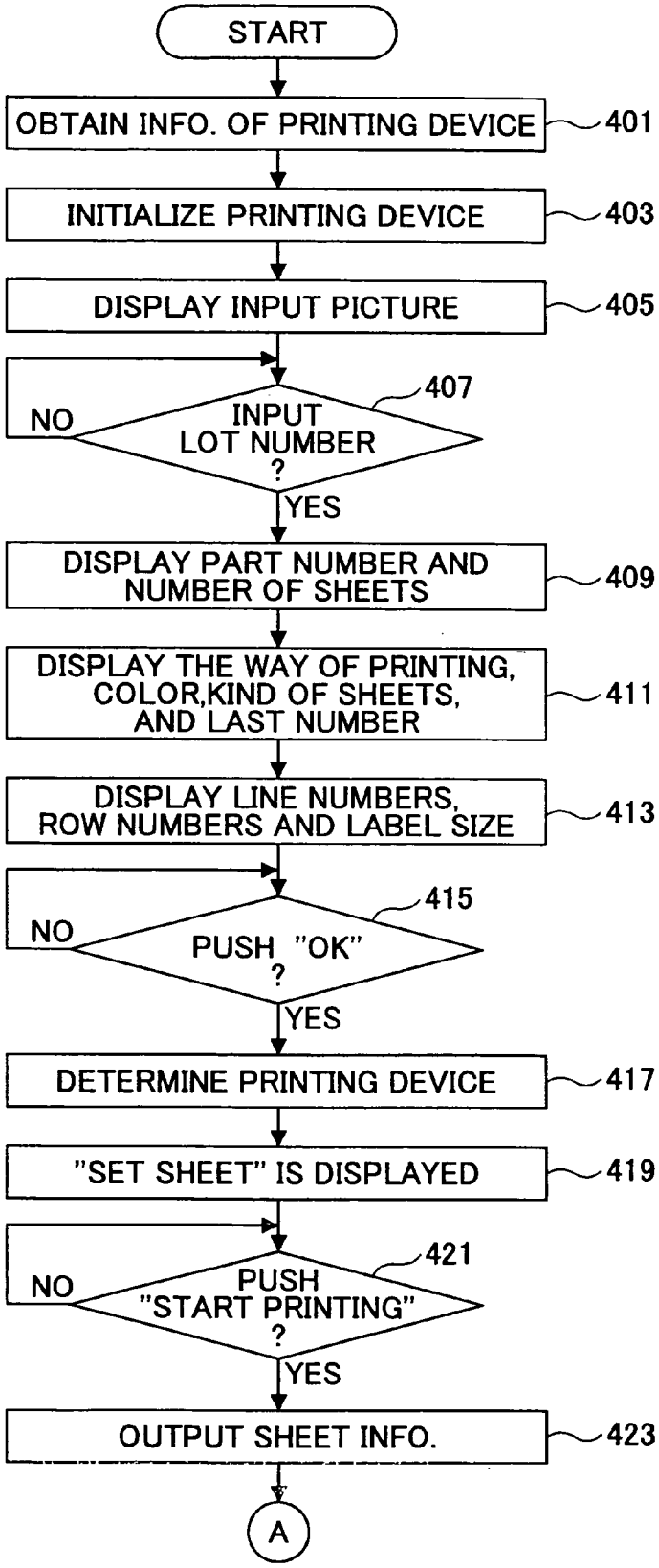
FIG. 7 is a first flowchart for explaining a barcode printing process in a personal computer shown in FIG. 2.
Figure 8:
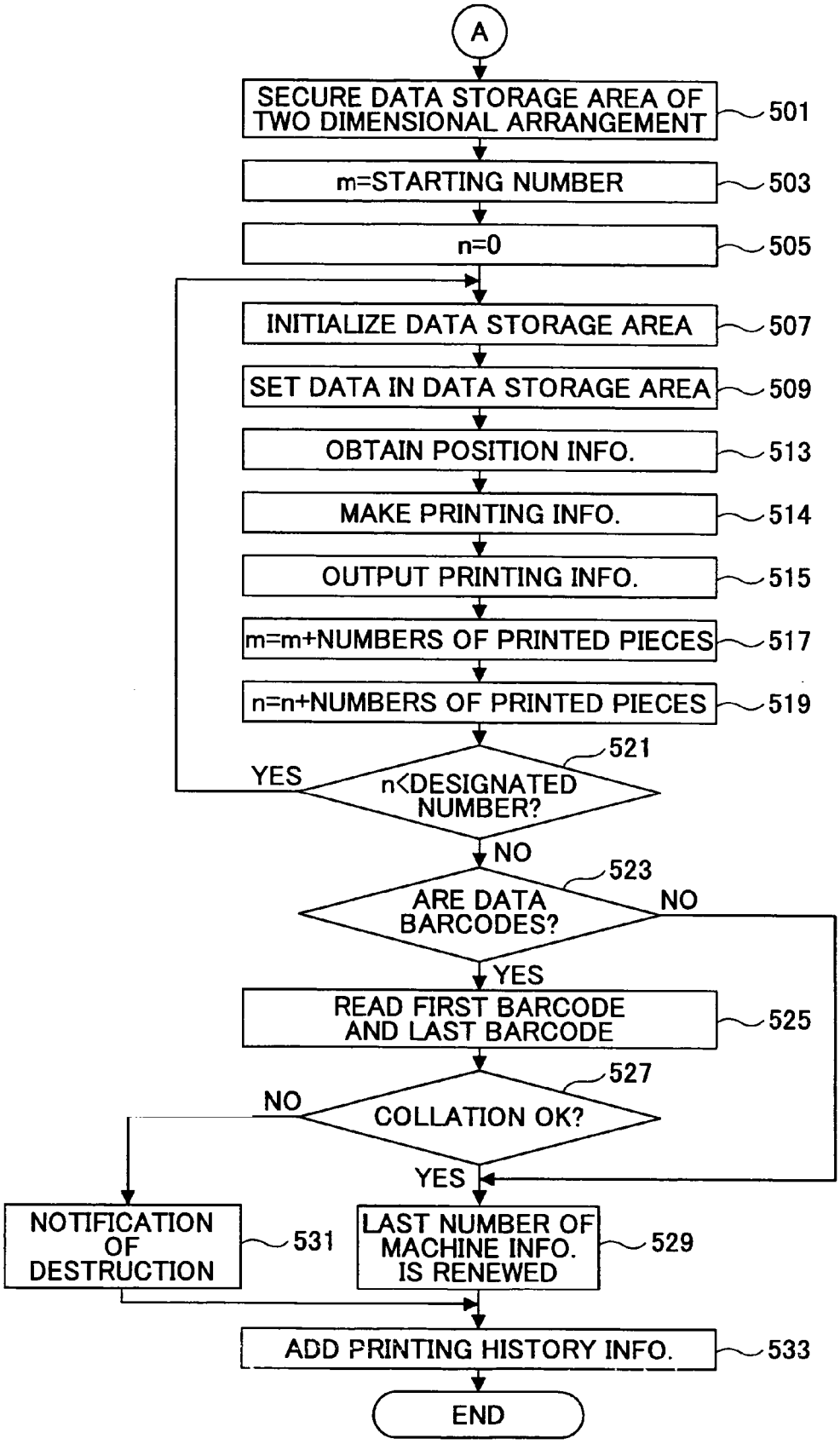
FIG. 8 is a second flowchart for explaining the barcode printing process in the personal computer shown in FIG. 2.

In addition, in the embodiment of the present invention, the program of the present invention is implemented by a program corresponding to FIG. 7 being recorded in the program area of the flash ROM 104 as the recording medium. Furthermore, the label is made by the above-discussed label making process.

Thus, as discussed above, according to the personal computer 100 of the embodiment of the present invention, continuous plural printing data sets printed on the single label are formed when the barcodes are printed on the label by using the printing device, and the plural printing data sets are recognized by the printing device as the single printing data sets to be printed on the single label. Therefore, it is possible to make the printing device print the continuous plural barcodes on the single label.

As shown in FIG. 16, for example, the barcode piece price can be dramatically reduced as compared with the conventional art where the way of printing is 1×1.

According to the embodiment of the present invention, the number of plural barcodes is continued in the line direction. Therefore, when the bar code is adhered on the product, it is possible to peel five or six pieces of the barcode from the pasteboard in the line direction by tweezers or the like at the same time and adhere them on the product in turn. As a result of this, a process for checking the barcode when the barcode is adhered on the product or a process for continuing the barcode number is not necessary. Hence, it is possible to simplify the processes.

The present invention is not limited to the above-discussed embodiments, but variations and modifications may be made without departing from the scope of the present invention.

For example, a case where the printer control apparatus is the personal computer is discussed in the above-mentioned embodiment. However, the present invention is not limited to this. For example, the present invention may be applied to a case where the printer control apparatus is an apparatus specialized for control of the printer.

In addition, a case where the printer control apparatus and the printer are individually provided is discussed in the above-mentioned embodiment. However, the present invention is not limited to this. For example, the present invention may be applied to a case where the printer control apparatus and the printer are provided in one body.

Furthermore, a case where the bar codes are arranged in both line directions and row direction is discussed in the above-mentioned embodiment. However, the present invention is not limited to this. For example, the present invention may be applied to a case where the bar codes are arranged in either the line direction or the row direction.

In addition, a case where both the bar codes and the number are printed is discussed in the above-mentioned embodiment. However, the present invention is not limited to this. For example, the present invention may be applied to a case where either the bar code or the number is printed.

Furthermore, a case where the program of the present invention is recorded in the flash ROM 104 is discussed in the above-mentioned embodiment. However, the present invention is not limited to this. For example, the present invention may be applied to a case where the program is recorded in other recording medium such as a CD, an optical magnetic disk, DVD, memory card, USB memory, a flexible disk, or the like. In this case, the program of the present invention may be loaded into the flash ROM 104 via a reproducing device (or reproducing interface) corresponding to the recording medium. In addition, the program of the present invention may be transferred to the flash ROM 104 via a network such as a LAN, intranet, the Internet or the like. In summary the program of the present invention may be loaded into the flash ROM 104 in any way.

Thus, as discussed above, according to the label making method of the present invention, the label where continuous plural data are printed can be made. In addition, according to the printer control apparatus of the present invention, it is possible to make the label printer print the continuous plural data sets on a single label. Furthermore, according to the program and the recording medium where the program is stored of the present invention, it is possible for the printer control apparatus to make the label printer print the continuous plural data sets on a single label.

More specifically, according to the above-discussed embodiment of the present invention, it is possible to provide a label making method for making a label where information is printed by a label printer; including the step of making the label printer recognize a continuous plurality of data sets as single data sets to be printed on a single label.

According to this label making method, the label printer recognizes continuous plural data sets as single data sets printed on a single label. Therefore, it is possible to make the label where the continuous plural data are printed.

The plural data sets may be arranged in at least one direction of a line direction being a sending direction of the label and a row direction perpendicular to the line direction. The plural data sets may bee arranged in the line direction and the row direction, and numbers of the plural data sets may be continued in the line direction.

According to the above-discussed embodiment of the present invention, it is also possible to provide a printer control apparatus configured to control a label printer, including: a making part configured to make a continuous plurality of data sets be printed on a single label; and a recognition part configured to make the label printer recognize the plural data sets as single data sets to be printed on the single label.

According to this printer control apparatus, continuous plural data sets printed on a single label are made by a making part. In addition, the label printer recognizes the plural data sets as single data sets printed on the single label by the recognizing part. Therefore, it is possible to make the label printer print continuous plural data sets on the single label.

The making part may arrange the plural data sets in at least one direction of a line direction being a sending direction of the label and a row direction perpendicular to the line direction. The plural data sets may be arranged in the line direction and the row direction, and numbers of the plural data sets may be continued in the line direction.

According to the above-discussed embodiment of the present invention, it is also possible to provide a printer control apparatus configured to control a label printer, including making means for making a continuous plural data sets be printed on a single label; and recognizing means for making the label printer recognize the plural data sets as single data sets to be printed on a single label.

According to this printer control apparatus, continues plural data sets printed on a single label are made by the making means. In addition, the label printer recognizes the plural data sets as single data sets printed on the single label by the recognizing means. Therefore, it is possible to make the label printer print continuous plural data sets on the single label.

The making means may arrange the plural data sets in at least one direction of a line direction being a sending direction of the label and a row direction perpendicular to the line direction. The plural data sets may be arranged in the line direction and the row direction, and numbers of the plural data sets may be continued in the line direction.

According to the above-discussed embodiment of the present invention, it is also possible to provide a computer program used by a printer control apparatus configured to control a label printer, the computer program including the step of making the label printer recognize a continuous plurality of data sets as single data sets to be printed on a single label.

Based on the above-mentioned program being loaded in the designated memory and the head address being loaded in the program counter, the printer control apparatus makes the label printer recognize the plural data sets as single data sets to be printed on the single label. In other words, according to this program, it is possible to make the printer control apparatus implement the above-mentioned label making method. Because of this, it is possible to make the label printer print continuous plural data sets on the single label.

According to the above-discussed embodiment of the present invention, it is also possible to provide a recording medium storing a computer program, the computer program readable by a computer, the computer program including the step of making a label printer recognize a continuous plurality of data sets as single data sets to be printed on a single label.

Since the above-mentioned program is recorded in this recording medium, it is possible to make the label printer print continuous plural data sets on the single label by making the computer implement the program stored in this recording medium.

This patent application is based on Japanese Priority Patent Application No. 2005-62245 filed on Mar. 7, 2005, the entire contents of which are hereby incorporated by reference.

What is claimed is:

1. A label making method for making a label where information is printed by a label printer, the label making method comprising:

securing a data storage area of a two-dimensional arrangement in a memory, the two-dimensional data storage area corresponding to an arrangement of columns and rows on a single label in which a plurality of data sets are to be printed;

setting a starting value of the plurality of data sets;

initializing the data storage area of the two-dimensional arrangement including forming a continuous plurality of data sets by incrementing the starting value of the plurality of data sets at regular intervals up to a designated value, and storing the continuous plurality of data sets in the storage area of the two-dimensional arrangement according to the arrangement of the columns and rows in which the stored continuous plurality of data sets are to be printed;

obtaining position information relative to a standard position on the single label on which the continuous plurality of data sets are to be printed according to the arrangement of the columns and rows;

generating printing information including the stored continuous plurality of data sets and the position information;

outputting the printing information to the label printer such that the continuous plurality of data sets are output to the label printer so as to follow a command of the label printer; and causing the label printer to recognize the continuous plurality of data sets as a single data set.

2. The label making method as claimed in claim 1, wherein the plurality of data sets are arranged in at least one direction of a row direction being a sending direction of the single label and a column direction perpendicular to the row direction.

3. The label making method as claimed in claim 2, wherein the plurality of data sets are arranged in the row direction and the column direction; and numbers of the plurality of data sets are continued in the column direction.

4. The label making method as claimed in claim 1, wherein at least one memory element of the two-dimensional data storage area has indicators for the arrangement of columns and rows on the single label in which the plurality of data sets are to be printed.

5. The label making method as claimed in claim 1, further comprising:

cutting a line in the single label in accordance with the arrangement of columns and rows in which the stored continuous plurality of data sets are printed on the single label by the label printer.

6. The label making method as claimed in claim 1, wherein the plurality of data sets include barcodes.

7. The label making method as claimed in claim 1, wherein the plurality of data sets include numbers.

8. The label making method as claimed in claim 1, wherein the plurality of data sets include barcodes and numbers.

9. A printer control apparatus configured to control a label printer, the printer control apparatus, comprising:

a securing module configured to secure a data storage area of a two-dimensional arrangement in a memory, the two-dimensional data storage area corresponding to an arrangement of columns and rows on a single label in which a plurality of data sets are to be printed;

a setting module configured to set a starting value of the plurality of data sets;

an initializing module configured to initialize a data storage area of a two-dimensional arrangement to form a continuous plurality of data sets by incrementing the starting value of the plurality of data sets at regular intervals up to a designated value, and to store the continuous plurality of data sets in the storage area of the two-dimensional arrangement according to the arrangement of the columns and rows in which the continuous plurality of data sets are to be printed;

a module configured to obtain position information relative to a standard position on the single label on which the stored continuous plurality of data sets are to be printed according to the arrangement of the columns and rows;

a module configured to generate printing information including the stored continuous plurality of data sets and the position information;

a module configured to output the printing information to the label printer such that the continuous plurality of data sets are output to the label printer so as to follow a command of the label printer; and causing the label printer to recognize the continuous plurality of data sets as a single data set.

10. The printer control apparatus as claimed in claim 9, wherein the making part arranges the plurality of data sets in at least one direction of a row direction being a sending direction of the single label and a column direction perpendicular to the row direction.

11. The printer control apparatus as claimed in claim 10, wherein the plurality of data sets are arranged in the row direction and the column direction; and numbers of the plurality of data sets are continued in the column direction.

12. The printer control apparatus as claimed in claim 9, wherein at least one memory element of the two-dimensional data storage area has indicators for the arrangement of columns and rows on the single label in which the plurality of data sets are to be printed.

13. A printer control apparatus configured to control a label printer, the printer control apparatus, comprising:

means for securing a data storage area of a two-dimensional arrangement in a memory, the two-dimensional data storage area corresponding to an arrangement of columns and rows on a single label in which a plurality of data sets are to be printed;

means for setting a starting value of the plurality of data sets;

means for initializing the data storage area of the two-dimensional arrangement including forming a continuous plurality of data sets by incrementing the starting value of the plurality of data sets at regular intervals up to a designated value, and storing the continuous plurality of data sets in the storage area of the two-dimensional arrangement according to the arrangement of the columns and rows in which the continuous plurality of data sets are to be printed;

means for obtaining position information relative to a standard position on the single label on which the stored continuous plurality of data sets are to be printed according to the arrangement of the columns and rows;

means for generating printing information including the stored continuous plurality of data sets and the position information;

means for outputting the printing information to the label printer such that the continuous plurality of data sets are output to the label printer so as to follow a command of the label printer: and means for causing the label printer to recognize the continuous plurality of data sets as a single data set.

14. The printer control apparatus as claimed in claim 13, the means for arranging the plurality of data sets in at least one direction of a row direction being a sending direction of the single label and a column direction perpendicular to the row direction.

15. The printer control apparatus as claimed in claim 14, wherein the plurality of data sets are arranged in the row direction and the column direction; and numbers of the plurality of data sets are continued in the column direction.

16. The printer control apparatus as claimed in claim 13, wherein at least one memory element of the two-dimensional data storage area has indicators for the arrangement of columns and rows on the single label in which the plurality of data sets are to be printed.

17. A non-transitory recording medium storing a computer program to be read and executed by a computer, the computer program comprising:

securing a data storage area of a two-dimensional arrangement in a memory, the two-dimensional data storage area corresponding to an arrangement of columns and rows on a single label in which a plurality of data sets are to be printed;

setting a starting value of the plurality of data sets;

initializing the data storage area of the two-dimensional arrangement including forming a continuous plurality of data sets by incrementing the starting value of the plurality of data sets at regular intervals up to a designated value, and storing the continuous plurality of data sets in the storage area of the two-dimensional arrangement according to the arrangement of the columns and rows in which the continuous plurality of data sets are to be printed;

obtaining position information relative to a standard position on the single label on which the stored continuous plurality of data sets are to be printed according to the arrangement of the columns and rows;

generating printing information including the stored continuous plurality of data sets and the position information;

outputting the printing information to a label printer such that the continuous plurality of data sets are output to the label printer so as to follow a command of the label printer; and causing the label printer to recognize the continuous plurality of data sets as a single data set.

18. The recording medium as claimed in claim 17, wherein at least one memory element of the two-dimensional data storage area has indicators for the arrangement of columns and rows on the single label in which the plurality of data sets are to be printed.

* * * * *